US008783935B2

(12) United States Patent
Lee et al.

(10) Patent No.: US 8,783,935 B2
(45) Date of Patent: Jul. 22, 2014

(54) ORGANIC LIGHT EMITTING DIODE LIGHTING APPARATUS

(75) Inventors: Jae-Goo Lee, Yongin (KR); Doo-Hwan Kim, Yongin (KR); Min-Woo Lee, Yongin (KR)

(73) Assignee: Samsung Display Co., Ltd. (KR)

( * ) Notice: Subject to any disclaimer, the term of this patent is extended or adjusted under 35 U.S.C. 154(b) by 280 days.

(21) Appl. No.: 13/410,825

(22) Filed: Mar. 2, 2012

(65) Prior Publication Data

US 2012/0257397 A1 Oct. 11, 2012

(30) Foreign Application Priority Data

Apr. 8, 2011 (KR) ..... 10-2011-0032819

(51) Int. Cl.

| | |
|---|---|
| ***F21V 7/04*** | (2006.01) |
| ***F21V 15/01*** | (2006.01) |
| ***F21V 23/00*** | (2006.01) |
| *F21Y 105/00* | (2006.01) |

(52) U.S. Cl.

CPC ..... *F21V 23/00* (2013.01); *F21Y 2105/008* (2013.01); *F21V 15/01* (2013.01)

USPC ..... 362/632; 362/398; 362/633; 362/364

(58) Field of Classification Search

USPC ..... 362/632–634, 398

See application file for complete search history.

(56) References Cited

U.S. PATENT DOCUMENTS

| | | | | |
|---|---|---|---|---|
| 6,151,486 | A * | 11/2000 | Holshouser et al. | 455/575.3 |
| 2009/0219712 | A1 * | 9/2009 | Verjans et al. | 362/147 |
| 2012/0050975 | A1 * | 3/2012 | Garelli et al. | 361/679.27 |

FOREIGN PATENT DOCUMENTS

| | | |
|---|---|---|
| KR | 10-2006-0018178 | 2/2006 |
| KR | 10-2006-0086656 | 8/2006 |
| KR | 10-2006-0122495 | 11/2006 |

* cited by examiner

*Primary Examiner* — William Carter

(74) *Attorney, Agent, or Firm* — Knobbe Martens Olson & Bear LLP

(57) ABSTRACT

An organic light emitting diode lighting apparatus is disclosed. The apparatus includes: a light emitting panel including an organic light emitting diode, a receiver receiving the light emitting panel, a cover coupled with the receiver to cover a front edge of the light emitting panel, at least one permanent magnet disposed on the receiver or the cover, and at least one of electromagnet disposed on the receiver or the cover member.

8 Claims, 4 Drawing Sheets

ORGANIC LIGHT EMITTING DIODE LIGHTING APPARATUS

CROSS-REFERENCE TO RELATED APPLICATIONS

This application claims priority to and the benefit of Korean Patent Application No. 10-2011-0032819 filed in the Korean Intellectual Property Office on Apr. 8, 2011, the entire contents of which are incorporated herein by reference.

BACKGROUND

1. Field

The described technology relates generally to a lighting apparatus. More particularly, the described technology relates to an organic light emitting diode lighting apparatus that uses an organic light emitting diode.

2. Description of the Related Technology

An organic light emitting diode lighting apparatus uses light emitted from an organic light emitting diode. The organic light emitting diode emits light produced by energy generated when excitons generated by combining electrons and holes in an organic emission layer fall from an excited state to a ground state.

The organic light emitting diode lighting apparatus includes a light emitting panel including an organic light emitting diode, a receiving member supporting the light emitting panel by receiving the same, and a cover member. The light emitting panel is received in a receiving space formed by combination of the receiving member and the cover member. The receiving member and the cover member are stably coupled to receive the light emitting panel and easily replace or repair the light emitting panel, or to be easily separated from each other on demand of a user.

The above information disclosed in this Background section is only for enhancement of understanding of the background of the described technology and therefore it may contain information that does not form the prior art that is already known in this country to a person of ordinary skill in the art.

SUMMARY OF CERTAIN INVENTIVE ASPECTS

An embodiment has been made in an effort to provide an organic light emitting diode lighting apparatus that can easily replace or repair a light emitting panel.

According to an embodiment, an organic light emitting diode lighting apparatus includes: a light emitting panel including an organic light emitting diode; a receiver receiving the light emitting panel; a cover coupled with the receiver to cover a front edge of the light emitting panel; at least permanent magnet disposed on at least one of the receiver and the cover; and at least one electromagnet disposed on at least one of the receiver and the cover.

The electromagnet may be configured to be magnetized to the same polarity as the permanent magnet when an electric current flows to the electromagnet.

The permanent magnet and the electromagnet may be respectively disposed at surfaces where the receiver and the cover face each other.

The electromagnet disposed at one of the receiver and the cover may correspond to at least a part of the electromagnet disposed at the other one of the receiver and the cover.

The organic light emitting diode lighting apparatus may further include a metallic member disposed at one of the receiver and the cover. In addition, the metallic member may correspond to at least a part of the permanent electromagnet disposed at the other of the receiver and the cover.

The organic light emitting diode lighting apparatus may further include a light emission driver supplying an electric current to the light emitting panel.

The organic light emitting diode lighting apparatus may further include an electromagnet driver supplying an electric current to the electromagnet.

The organic light emitting diode lighting apparatus may further include a power supply connected with the light emission driver and the electromagnet driver.

The organic light emitting diode lighting apparatus may further include a plurality of pins disposed between the receiver and the light emitting panel to support edges of the light emitting panel.

The light emission driver may transmit an electric current to the light emitting panel through the plurality of pins.

The plurality of pins may have an elastic force.

According to the embodiment, the organic light emitting diode lighting apparatus can easily replace or repair a light emitting panel.

DETAILED DESCRIPTION OF CERTAIN INVENTIVE EMBODIMENTS

Figure 1:
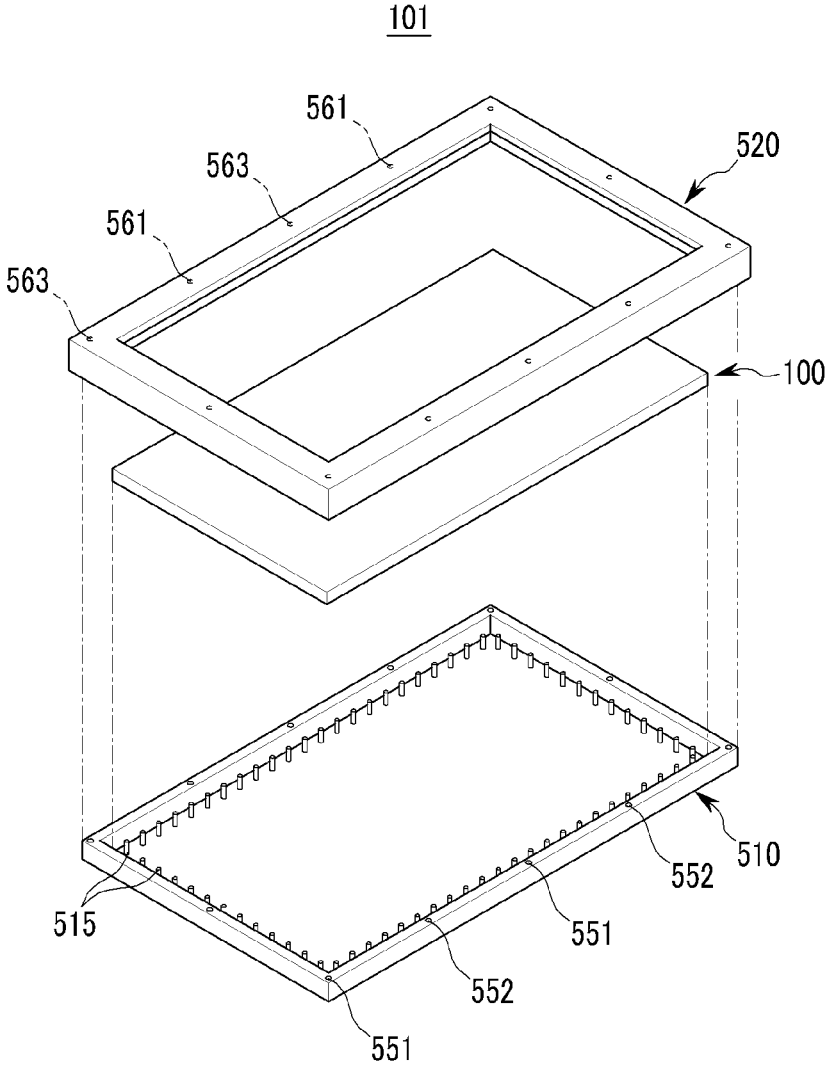
FIG. 1 is an exploded perspective view of an embodiment of an organic light emitting diode lighting apparatus.

The present invention will be described more fully hereinafter with reference to the accompanying drawings, in which certain embodiments of the invention are shown. As those skilled in the art would realize, the described embodiments may be modified in various ways, without departing from the spirit or scope of the present invention. Further, like reference numerals generally designate like elements throughout the specification.

In addition, the size and thickness of each component shown in the drawings are arbitrarily shown for understanding and ease of description, but the present invention is not limited thereto. In the drawings, the thickness of layers, films, panels, regions, and the like, may be exaggerated for clarity. It will be understood that when an element such as a layer, film, region, or substrate is referred to as being "on" another element, it can be directly on the other element or intervening elements may also be present.

An embodiment of an organic light emitting diode lighting apparatus 101 will be described with reference to FIG. 1 to FIG. 3.

As shown in FIG. 1, an embodiment of an organic light emitting diode lighting apparatus 101 includes a light emitting panel 100, a receiver 510, a cover 520, a plurality of pins 515, at least one of permanent magnets 551 and 561, and at least one electromagnet 552.

Figure 4:
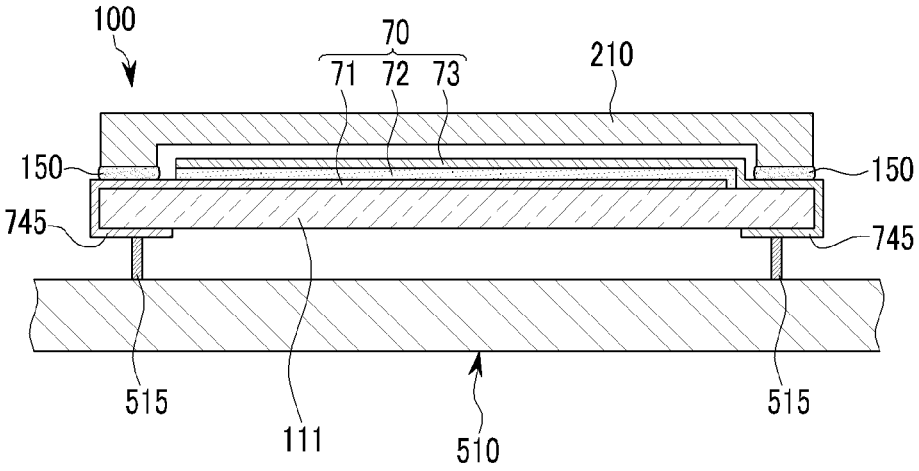
FIG. 4 is an enlarged cross-sectional view of a light emission panel illustrated in the embodiment of FIG. 1.

The light emitting panel 100 includes an organic light emitting diode 70 (shown in FIG. 4). The light emitting panel 100 emits light using the organic light emitting diode 70. The receiver 510 supports the light emitting panel 100 by receiving the same. In addition, the cover 520 is combined with the receiver 510 to cover a front edge of the light emitting panel 100.

The plurality of pins 515 are arranged between the receiver 510 and the light emitting panel 100 to support the edge of the light emitting panel 100. The plurality of pins 515 contact the light emitting panel 100 and transmit an electric current thereto.

The plurality of pins 515 may have an elastic force. The pins 515 may be formed in the shape of a pin-spring. Thus, the plurality of pins 515 can stably support the light emitting panel 100 by reducing impact to the light emitting panel 100. Therefore, impact resistance of the organic light emitting diode lighting apparatus 101 can be improved in some embodiments.

In FIG. 1, the plurality of pins 515 are arranged respectively corresponding to all the edges of the light emitting panel 100. In other embodiments, the plurality of pins 515 may be arranged to respectively correspond to a part of the edges of the light emitting panel 100.

The permanent magnets 551 and 561 and the electromagnet 552 combine or separate the receiver 510 and the cover 520. The permanent magnets 551 and 561 and the electromagnet 552 are arranged on planes of the receiver 510 and the cover 520, arranged opposite to each other.

The permanent magnets 551 and 561 may be arranged in at least one of the receiver 510 and the cover 520. In FIG. 1, the permanent magnets 551 and 561 are arranged in both the receiver 510 and the cover 520, but other embodiments are not limited thereto.

Figure 2:
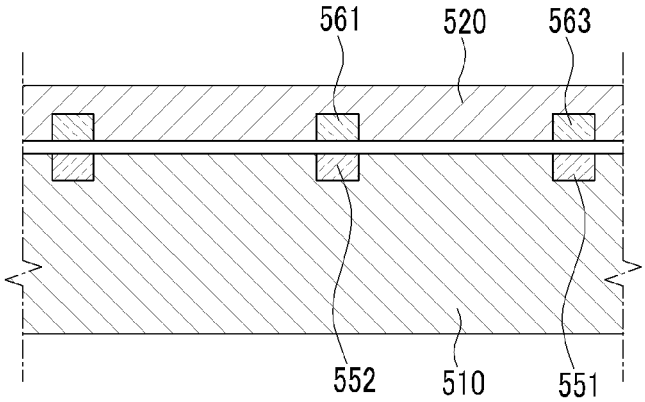
FIG. 2 is a partially enlarged cross-sectional view of a receiving member and a cover member illustrated in the embodiment of FIG. 1.

As shown in FIG. 2, with reference of the coupling state of the receiver 510 and the cover 520, the permanent magnet 551 disposed in the receiver 510 and the permanent magnet 561 disposed in the cover 520 do not overlap each other. In some embodiments, the permanent magnets 551 and 561 have the same polarity. In other embodiments, the organic light emitting diode lighting apparatus may further include an additional permanent magnet disposed in the cover 520, facing the permanent magnet 551 disposed in the receiver 510. In such embodiments, the polarity of the additional permanent magnet and the polarity of the facing permanent magnet 561 may be different from each other.

The electromagnet 552 may be disposed in at least one of the receiver 510 and the cover 520. In the embodiment of FIG. 2, the electromagnet 552 is disposed in the receiver 510. In other embodiments, the electromagnet 552 may also be disposed in the cover 520.

With reference to the coupling state of the receiver 510 and the cover 520, the electromagnet 552 disposed in the receiver 510 is disposed to face at least a part of the permanent magnet 561 disposed in the cover 520. The permanent magnets 561 disposed in the cover 520 entirely or partially face the electromagnet 552 disposed in the receiver 510. When an electric current flows to the electromagnet 552, the electromagnet 552 is magnetized to the same polarity of the facing permanent magnet 561.

The organic light emitting diode lighting apparatus 101 may further include a metallic member 563. With reference to the coupling state of the receiver 510 and the cover 520, the metallic member 563 may be disposed in the cover 520 to face at least a part of the permanent magnet 551 disposed in the receiver 510. In other embodiments, the metallic member 563 may be disposed in the receiver 510 to face a part of the permanent magnet 561 disposed in the cover 520.

Figure 3:
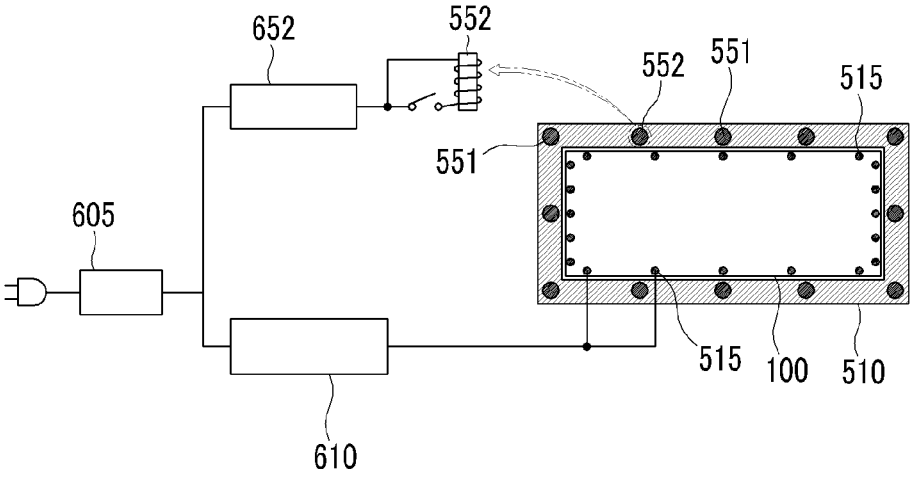
FIG. 3 is a schematic diagram of the embodiment of an organic light emitting diode lighting apparatus of FIG. 1.

As shown in FIG. 3, the organic light emitting diode lighting apparatus 101 further includes a light emission driver 610 supplying an electric current to the light emitting panel 100, an electromagnet driver 652 supplying an electric current to the electromagnet 552, and a power supply 605 connected with the light emission driver 610 and the electromagnet driver 652.

The light emission driver 610 supplies an electric current through the plurality of pins 515 for light emission of the light emitting panel 100.

The electromagnet driver 652 selectively supplies an electric current to the electromagnet 552 if necessary. No electric current is supplied to the electromagnet 552 when the receiver 510 and the cover 520 are in the coupling state. The receiver 510 and the cover 520 are coupled to each other by a magnetic force of the permanent magnet 551. The receiver 510 and the cover 520 can become separated when an electric current is supplied to the electromagnet 552 through the electromagnet driver 652. When receiving the electric current, the electromagnet 552 is magnetized to the same polarity of the permanent magnet 561 (shown in FIG. 2) facing the electromagnet 552. Accordingly, a repulsive force is generated between the electromagnet 552 and the permanent magnet 561 such that the receiver 510 and the cover 520 can be easily separated from each other by the repulsive force. When the supply of the electric current to the electromagnet 552 through the electromagnet driver 652 is stopped, the receiver 510 and the cover 520 can be easily coupled with each other.

With such a configuration, embodiments of the light emitting panel 100 of the organic light emitting diode lighting apparatus 101 can be easily replaced or repaired. In addition, the organic light emitting diode lighting apparatus 101 can be easily assembled or disassembled. Further, the organic light emitting diode lighting apparatus 101 may have improved impact resistance.

Hereinafter, a structure of the light emitting panel 100 contacting the plurality of pins 515 will be described in further detail with reference to FIG. 4.

As shown in FIG. 4, the light emitting panel 100 includes a substrate main body 111, an organic light emitting diode 70, a sealant 150, and an encapsulation member 210. The light emitting panel 100 further includes an electrode pad 745 disposed at a bottom edge thereof so as to be connected with the organic light emitting diode 70.

The substrate main body 111 may be a transparent glass substrate made of glass, quartz, or ceramic, or may be an acryl-based, polyimide-based, or polyaniline-based substrate. The substrate main body 111 is divided into a light emission region and a sealing region surrounding the light emission region. The organic light emitting diode 70 is disposed on the light emission region and the sealant 150 is disposed on the sealing region.

The organic light emitting diode 70 includes a first electrode 71 disposed on the substrate main body 111, an organic emission layer 72 disposed on the first electrode 71, and a second electrode 73 disposed on the organic emission layer 72.

In some embodiments, the first electrode 71 is an electron injection electrode that injects electrons to the organic emission layer 72, and the second electrode 73 is a hole injection electrode that injects holes to the organic emission layer 72. In other embodiments, the first electrode 71 may be a hole injection electrode and the second electrode 73 may be an electron injection electrode.

The first electrode 71 may be formed of a reflective layer and the second electrode 73 may be formed of a transparent conductive layer or a semitransparent layer.

Transparent conductive layers include at least one of indium tin oxide (ITO), indium zinc oxide (IZO), zinc indium tin oxide (ZITO), gallium indium tin oxide (GITO), indium oxide ($In_2O_3$), zinc oxide (ZnO), gallium indium zinc oxide (GIZO), gallium zinc oxide (GZO), fluorine tin oxide (FTO), and aluminum-doped zinc oxide (AZO). Such transparent conductive layers have a relatively high work function. Thus, the second electrode 73 formed of the transparent conductive layer may easily inject holes. When the second electrode 73 is formed of the transparent conductive layer, the light emitting panel 100 may further include an auxiliary electrode formed of a metal that has relatively low resistivity to supplement relatively high resistivity of the second electrode 73.

The reflective layer and the semitransparent layer are formed using a metal such as magnesium (Mg), calcium (Ca), lithium (Li), zinc (Zn), and aluminum (Al), or an alloy thereof. The reflective layer and the semitransparent layer are determined by thickness. In general, the semitransparent layer has a thickness less than about 200 nm. Light transmittance of the semitransparent layer increases as the thickness decreases, and increases as the thickness decreases.

In some embodiments, the reflective layer or the semitransparent layer is the first electrode that is an electrode injection electrode, and therefore is preferably formed of a metal that has a relatively low work function, less than about 4.5 eV.

The second electrode 73 is formed of the semitransparent electrode and the first electrode 71 is formed of the reflective layer, light use efficiency can be improved by using a microcavity effect.

The second electrode 73 may have a multi-layered structure including a transparent conductive layer and a semitransparent layer. The second electrode 73 can acquire the microcavity effect while having a high work function.

The organic emission layer 72 may be formed of a multilayer including an emission layer, a hole injection layer (HIL), a hole transport layer (HTL), an electron transport layer (ETL), and an electron injection layer (EIL). In some embodiments, layers excluding the emission layer may be omitted. In embodiments where the organic emission layer 72 includes all the above-stated layers, the hole injection layer (HIL) is disposed on the first electrode 71 which is a hole injection electrode, and the hole transport layer (HTL), the emission layer, the electron transport layer (ETL), and the electron injection layer (EIL) are sequentially layered thereon.

The organic emission layer 72 may further include another layer if necessary. In some embodiments, the organic emission layer 72 may further include a resonance layer to maximize the microcavity effect.

The sealant 150 is disposed on the sealing region of the substrate main body 111. The sealant 150 may be formed of a frit or a curable resin.

The encapsulation member 210 and the substrate main body 111 are sealed by the sealant 150 and thus the encapsulation member 210 covers the organic light emitting diode 70. The encapsulation member 210 may be a glass substrate, or an acryl-based, polyimide-based, or a polyaniline-based plastic substrate.

When the substrate main body 111 and the encapsulation member 210 are formed of plastic substrates, the light emitting panel 100 may have flexibility.

A portion of the encapsulation member 210, corresponding to the light emission region of the substrate main body 111 where the organic light emitting diode 70 of the substrate main body 111 is disposed, is indented. Thus, the encapsulation member 210 is stably distanced from the organic light emitting diode 70 while being sealed with the substrate main body 111 through the sealant 150 such that damage to the organic light emitting diode 70 can be prevented.

The electrode pad 745 receives an electric current through the plurality of pins 515 and transmits the electric current to the organic light emitting diode 70.

In various embodiments, the light emitting panel 100 may have various structures known to a person skilled in the art.

While this disclosure has been described in connection with certain embodiments, it is to be understood that the invention is not limited to the disclosed embodiments, but, on the contrary, is intended to cover various modifications and equivalent arrangements included within the spirit and scope of the appended claims.

DESCRIPTION OF SYMBOLS

70: organic light emitting element or diode (OLED)
71: first electrode
72: organic emission layer
73: second electrode
100: light emitting panel
101: organic light emitting diode (OLED) lighting apparatus
111: substrate main body
150: sealant
210: encapsulation member
510: receiver
515: pin
520: cover
551, 561: permanent magnet 552: electromagnet
563: metallic member
605: power supply
610: light emission driver
652: electromagnet driver
745: electrode pad

What is claimed is:

1. An organic light emitting diode lighting apparatus comprising:

a light emitting panel including an organic light emitting diode;

a receiver receiving the light emitting panel;

a cover coupled with the receiver to cover a front edge of the light emitting panel;

at least one permanent magnet disposed on at least one of the receiver and the cover;

at least one electromagnet disposed on at least one of the receiver and the cover; and a power supply connected with a light emission driver supplying a first electric current to the light emitting panel and an electromagnet driver supplying a second electric current to the electromagnet.

2. The organic light emitting diode lighting apparatus of claim 1, wherein the electromagnet is configured to be magnetized to the same polarity as the permanent magnet when an electric current flows to the electromagnet.

3. The organic light emitting diode lighting apparatus of claim 2, wherein the permanent magnet and the electromagnet are respectively disposed at surfaces where the receiver and the cover face each other.

4. The organic light emitting diode lighting apparatus of claim 3, wherein the electromagnet disposed at one of the receiver and the cover corresponds to at least a part of the electromagnet disposed at the other one of the receiver and the cover.

5. The organic light emitting diode lighting apparatus of claim 4, further comprising a metallic member disposed at one of the receiver and the cover, and wherein the metallic member corresponds to at least a part of the permanent electromagnet disposed at the other one of the receiver and the cover.

6. The organic light emitting diode lighting apparatus of claim 1, further comprising a plurality of pins disposed between the receiver and the light emitting panel to support edges of the light emitting panel.

7. The organic light emitting diode lighting apparatus of claim 6, wherein the light emission driver transmits an electric current to the light emitting panel through the plurality of pins.

8. The organic light emitting diode lighting apparatus of claim 6, wherein the plurality of pins have an elastic force.

* * * * *